US008438738B2

(12) United States Patent
Lo

(10) Patent No.: US 8,438,738 B2
(45) Date of Patent: May 14, 2013

(54) SAFETY FOLDING KNIFE

(76) Inventor: Yen-Fen Lo, Kaohsiung (TW)

( * ) Notice: Subject to any disclaimer, the term of this patent is extended or adjusted under 35 U.S.C. 154(b) by 253 days.

(21) Appl. No.: 13/064,510

(22) Filed: Mar. 30, 2011

(65) Prior Publication Data

US 2012/0198701 A1 Aug. 9, 2012

(30) Foreign Application Priority Data

Feb. 9, 2011 (TW) ..... 100202494 U

(51) Int. Cl.
*B26B 1/00* (2006.01)

(52) U.S. Cl.
USPC ..... 30/161; 30/155; 30/157; 30/160

(58) Field of Classification Search ..... 30/151, 30/153, 155–161, 164, 330, 331, 340, 342; 7/118–120
See application file for complete search history.

(56) References Cited

U.S. PATENT DOCUMENTS

| | | | | |
|---|---|---|---|---|
| 2006/0162168 | A1* | 7/2006 | Kao | 30/161 |
| 2007/0039190 | A1* | 2/2007 | Hinderer | 30/153 |
| 2007/0151110 | A1* | 7/2007 | Chen | 30/155 |
| 2009/0133267 | A1* | 5/2009 | Steigerwalt et al. | 30/159 |
| 2010/0325897 | A1* | 12/2010 | Chu | 30/161 |
| 2011/0067246 | A1* | 3/2011 | Perez | 30/158 |
| 2012/0144677 | A1* | 6/2012 | Chang | 30/161 |

* cited by examiner

*Primary Examiner* — Phong Nguyen
(74) *Attorney, Agent, or Firm* — Bacon & Thomas, PLLC

(57) ABSTRACT

The present invention is to provide a safety folding knife comprising a blade having an end pivotally coupled to an end of a handle, such that the other end of the blade can be rotated out of or into the handle. The handle includes an elastic stop plate therein, which has an end fixed onto the handle and the other end tilted and extended towards a side of the blade. When the blade is turned fully out of the handle, the other end of the elastic stop plate can be abutted against the end of the blade so as to maintain the blade in a fully opened state, and a resisting block installed inside the handle then moves and firmly blocks the elastic stop plate to avoid the blade from being accidentally turned backward to the handle.

7 Claims, 3 Drawing Sheets

SAFETY FOLDING KNIFE

FIELD OF THE INVENTION

The present invention relates to a folding knife, more particularly to a safety handle having a resisting block for blocking an elastic stop plate and making sure that the elastic stop plate can firmly abut against an end of a blade, which is fully turned out of a handle and is unable to be turned into the handle.

BACKGROUND OF THE INVENTION

As the system of a five-day work week was introduced to Taiwan in recent years, people in Taiwan pay more and more attentions to leisure activities in holidays and start going out for outdoor activities such as fishing, barbeque or hiking. For outdoor activities, various types of knives available in the market are usually used for cutting food, fishing line or firewood or opening cans. In particular, there is a type of folding knives, not just being popular only, but also providing an easy carry, and thus the folding knives become a favorable tool of outdoor enthusiasts. A folding knife for outdoor activities is used as an example for illustrating the invention as follows:

With reference to FIG. 1 for a conventional folding knife 10, the conventional folding knife 10 comprises a handle 11 and a blade 12, wherein the handle 11 is formed by combining a first handle portion 111, a metal plate 112 and a second handle portion 113 together, and a position proximate to an end of the blade 12 is pivotally installed between the first handle portion 111 and the metal plate 112, such that the other end of the blade 12 can be turned outwardly from a side of the handle 11 to the outside of the handle 11 or turned inwardly and accommodated into the handle 11. The metal plate 112 includes a stop plate 114, and if the blade 12 of the folding knife 10 is accommodated in the handle 11, the stop plate 114 will movably abut against a side of the blade 12. After the blade 12 is turned outwardly and completely from the handle 11, an end of the stop plate 114 will be movably tilted towards the first handle portion 111 and abutted against an end of the blade 12, such that when a user is using the conventional folding knife 10, the stop plate 114 can abut and support the blade 12 to prevent the blade 12 from being turned and folded into the handle 11 suddenly. Therefore, users can use the conventional folding knife 10 at ease.

Although the aforementioned conventional folding knife 10 is simple structured and used extensively by outdoor enthusiasts, its application still has substantial drawbacks. Since the conventional folding knife 10 relies on the stop plate 114 to abut and support the blade 12, the stop plate 114 of the conventional folding knife 10 may be deformed or shifted due to an excessive force applied by the user, and the blade 12 cannot be abutted by the stop plate 114 anymore. As a result, the blade 12 will lose its abutting force suddenly when the folding knife is unfolded completely, and the blade 12 will be turned with a large force towards the handle 11, and the user's finger or palm may be clamped or cut by the blade 12, or the user's safety may be jeopardized. Obviously, the structural strength of the conventional folding knife 10 is not strong enough, and the design of the conventional folding knife 10 still has a safety concern.

From the description above, the conventional folding knife has a low structural strength and simply relies on the stop plate to abut and support the blade, so that the conventional folding knife may lose its abutting force suddenly in its use, and the blade may be turned suddenly to cut the user due to the deformation or displacement of the stop plate. Therefore, it is an important subject for related designers and manufacturers to design and manufacture a safety folding knife with a blade that can be turned outwardly to the outside of the handle, such that when the elastic stop plate abuts against an end of the blade, a resisting block can be released from the containing slot on the internal side of the handle, and driven by the elastic force of an elastic element to turn to a position capable of abutting against an internal side of the handle and a side of the elastic stop plate, such that the elastic stop plate can be blocked by the resisting block to maintain a status of abutting against an end of the blade and overcome the problem of folding the blade back into the handle easily or cutting the user.

SUMMARY OF THE INVENTION

In view of the aforementioned shortcomings of the conventional folding knife having a low structural strength or cutting the users easily when an excessive force is applied to the blade, the inventor of the present invention based on years of experience in the related industry to conduct extensive researches and experiments, and finally designed and developed a safety folding knife in accordance with the present invention to improve the stability and safety of using the folding knife.

It is a primary objective of the present invention to provide a safety folding knife comprising a handle, a blade and a resisting block, wherein the handle is composed of a first plate, a second plate and a third plate, and a position proximate to an end of the blade is pivotally coupled to a position between the first plate and the second plate and proximate to an end of the handle through a pivot, such that the other end of the blade can be rotated about the pivot, and a side of the blade can be turned outwardly to the outside of the handle or turned inwardly and accommodated into the handle. The second plate includes an elastic stop plate thereon, and an end of the elastic stop plate is fixed onto the second plate, and the other end of the elastic stop plate is tilted and extended towards the first plate. In the process of turning the blade outwardly to the outside of the handle, a side proximate to the other end of the elastic stop plate can be abutted against a side of the blade. After the blade is turned outwardly and completely to the outside of the handle, the other end of the elastic stop plate can abut against an end of the blade, such that the blade is situated at a completely unfolded state (fully opened state). Further, a first containing slot is concavely formed on a side of the third plate at a position corresponding to the second plate, and a resisting block is pivotally installed on another side of the elastic stop plate at a position proximate to the other end of the elastic stop plate and movably fixed between the elastic stop plate and the third plate, wherein an end of the resisting block is extended outside the handle and turnable and rotatable by an external force, and the resisting block is disposed at a position corresponding to the first containing slot and has a shape matched with the shape of the first containing slot. If the resisting block is rotated to the first containing slot, engaged with the first containing slot, and accommodated into the first containing slot, the other end of the elastic stop plate will become a free end and separable from an end of the blade by a force, such that the blade can be turned inwardly and accommodated into the handle. Further, an elastic element (curved metal rod or spring) is installed between the other end of the resisting block and the second plate or the third plate and provided for applying an elastic force to the resisting block, such that when the blade is turned outwardly to the outside of the handle and the other end of the elastic stop plate abuts against an end of the blade, the resisting block can be released from the first containing slot and driven by the elastic force of the elastic element. The resisting block is turned to a position capable of abutting a side of the third plate and the other side of the elastic stop plate, and the elastic stop plate is then blocked by the resisting block, so that the other end of the elastic stop plate can maintain the status of abutting against an end of the blade, and the blade cannot be turned inwardly and accommodated into the handle.

Another objective of the present invention is to form a second containing slot concavely disposed on a side of the third plate and at a position proximate to the first containing slot and interconnected with the first containing slot, so that when the first plate, the second plate and the third plate are combined, the elastic element can be accommodated into the second containing slot to reduce the overall volume of the safety folding knife.

Another objective of the present invention is to provide a safe way of using the folding knife by simply turning the blade out from the handle completely, and the elastic element can drive the resisting block to turn the resisting block to abut against a side of the third plate and another side of the elastic stop plate automatically, so as to assure that the elastic stop plate is blocked by the resisting block and the blade is situated at a completely unfolded state. On the other hand, if a user wants to fold the blade back into the handle, the user simply slides an end of the resisting block to a position capable of engaging the containing slot and then presses the elastic stop plate to release the abutting force applied from the other end of the elastic stop plate to an end of the blade in order to fold the blade back into the handle. With the design of the safety folding knife in accordance with the present invention, the elastic stop plate can be prevented from losing its abutting force suddenly or turning towards the handle when the blade is unfolded completely due to the deformation or displacement caused by applying an excessive force by the user. Therefore, the invention can provide a way of protecting the user's safety.

DETAILED DESCRIPTION OF THE PREFERRED EMBODIMENTS

Figure 1:
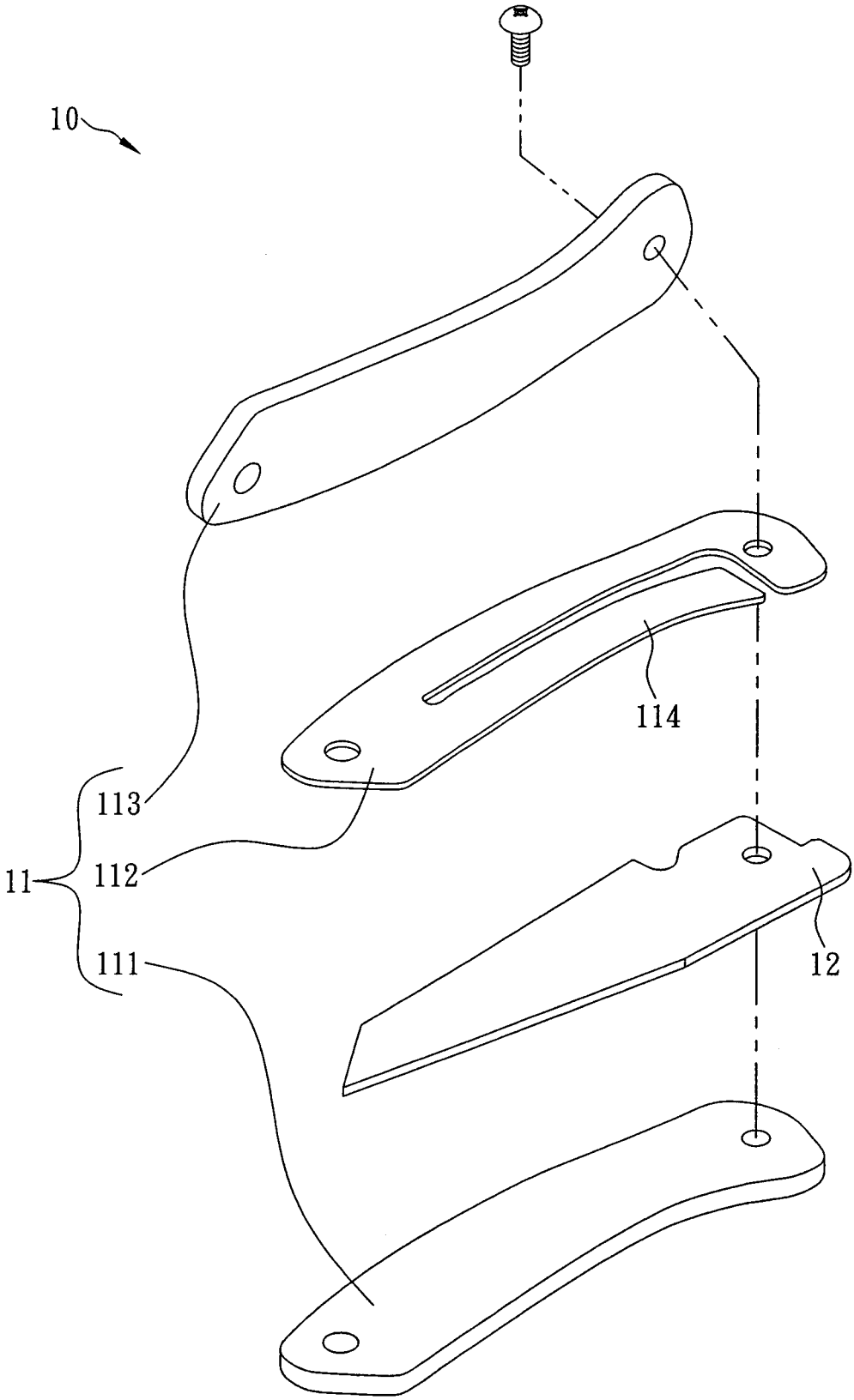
FIG. 1 (Prior Art)
FIG. 1 is a schematic view of a conventional folding knife.
Figure 2:
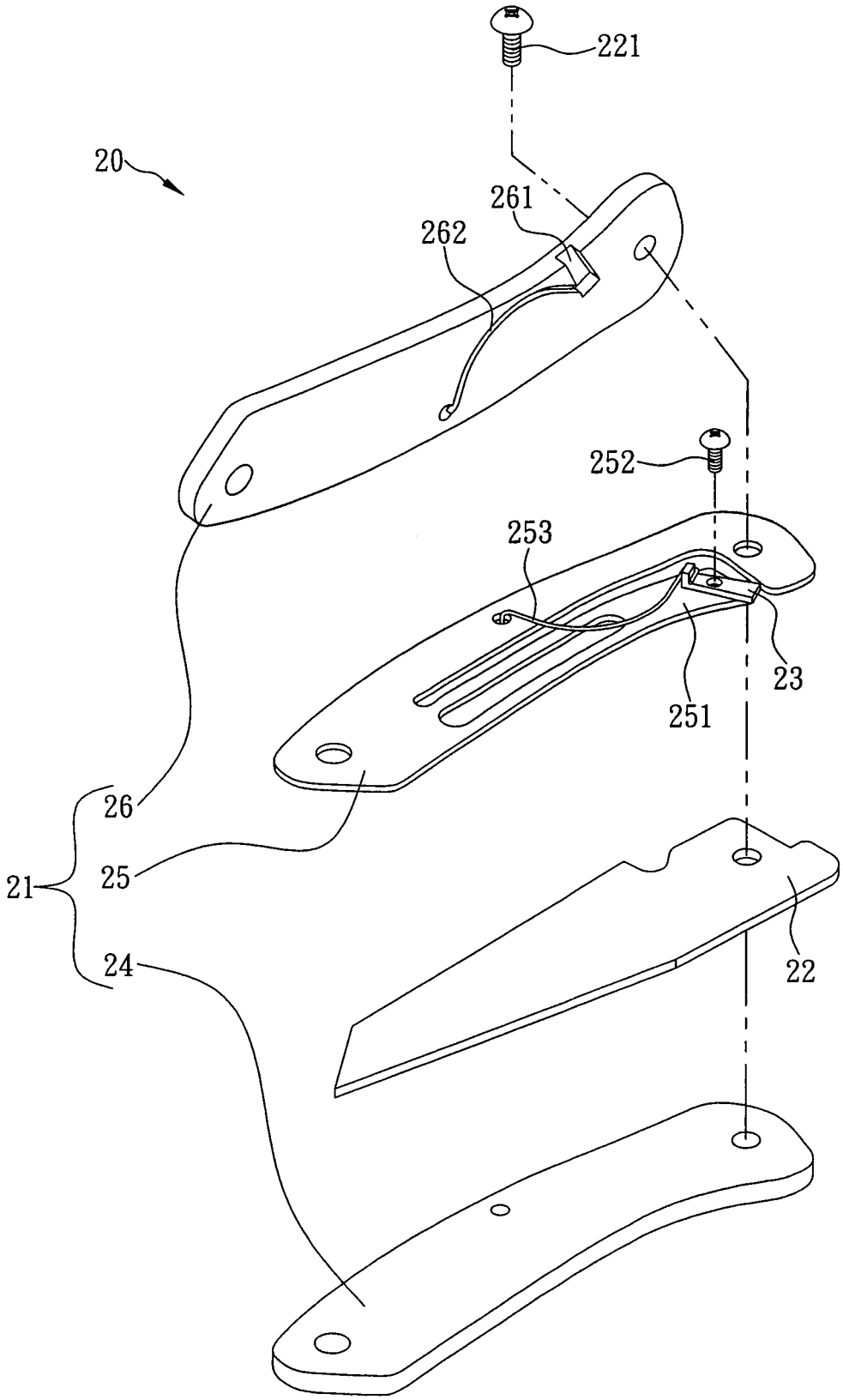
FIG. 2 is a schematic view of a preferred embodiment of the present invention.
Figure 3:
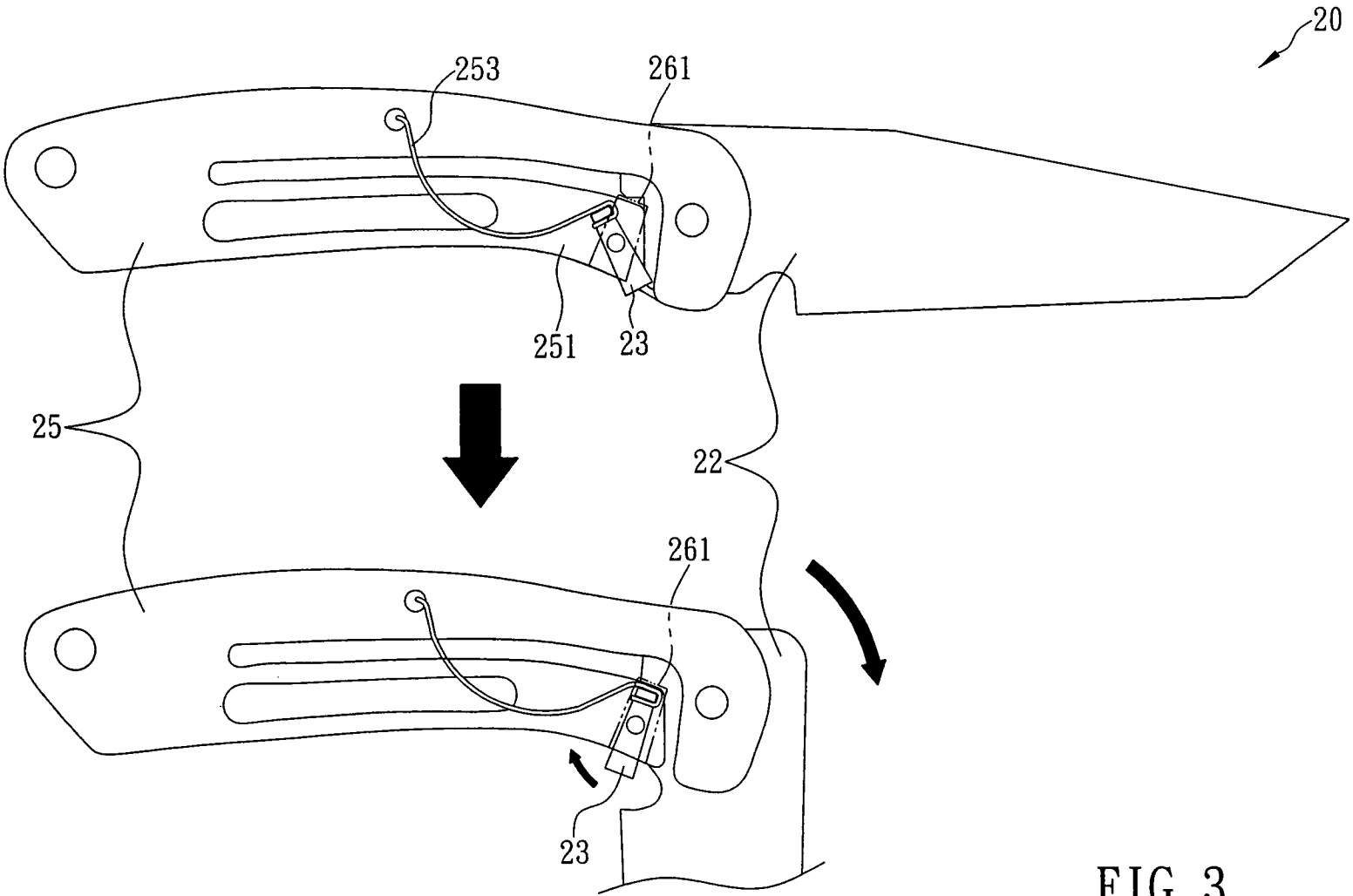
FIG. 3 is another schematic view of a preferred embodiment of the present invention.

With reference to FIGS. 2 and 3 for a safety folding knife 20 in accordance with a preferred embodiment of the present invention, the safety folding knife 20 comprises a handle 21, a blade 22 and a resisting block 23, wherein the handle 21 is composed of a first plate 24, a second plate 25 and a third plate 26, and a position proximate to an end of the blade 22 is pivotally coupled to a position between the first plate 24 and the second plate 25 and proximate to an end of the handle 21 by a first pivot 221, such that the other end of the blade 22 can be rotated about the first pivot 221, and a side of the blade 22 is turned outwardly to the outside of the handle 21 or turned inwardly and accommodated into the handle 21. In this preferred embodiment, the first pivot 221 is in form of a screw passed through the third plate 26, the second plate 25 and the blade 22 sequentially and screwed onto the first plate 24, such that the blade 22 can be turned outwardly to the outside of the handle 21 or turned inwardly and accommodated into the handle 21. However, the first pivot 221 also can be in form of a rivet for riveting and connecting the third plate 26, the second plate 25, the blade 22 and the first plate 24 as a whole. It is noteworthy to point out that the first pivot 221 of the present invention is not limited to the screw or rivet, but any other equivalent device can be used as long as it can combine the blade 22 with the handle 21 securely as a whole and turn the blade 22 outwardly to the outside of the handle 21 or turn the blade 22 inwardly and accommodated into the handle 21.

The second plate 25 includes an elastic stop plate 251 thereon, wherein the elastic stop plate 251 is made of a metal material with elasticity, and an end of the elastic stop plate 251 is fixed onto the second plate 25, and the other end of the elastic stop plate 251 is tilted and extended towards the first plate 24. In the process of turning the blade 22 outwardly to the outside of the handle 21, a side proximate to the other end of the elastic stop plate 251 can abut against a side of the blade 22. When the blade 22 is turned out completely from the handle 21, the other end of the elastic stop plate 251 can abut against an end of the blade 22 to situate the blade 22 at a completely unfolded state.

In FIGS. 2 and 3, the resisting block 23 is pivotally installed onto the other side proximate to the other end of the elastic stop plate 251 by a second pivot 252 and movably fixed between the elastic stop plate 251 and the third plate 26 (wherein the second pivot 252 is in form of a screw or a rivet), and an end of the resisting block 23 is extended to the outside of the handle 21 and turnable and rotatable by an external force. Further, a first containing slot 261 is concavely formed at a position on a side of the third plate 26 and corresponding to the resisting block 23, and the first containing slot 261 has a shape matched with the shape of the resisting block 23, so that the first containing slot 261 can be provided for engaging the resisting block 23 and accommodating the resisting block 23 into the first containing slot 261. Now, the other end of the elastic stop plate 251 becomes a free end and separable from an end of the blade 22 by an external force, such that the blade 22 can be turned inwardly and accommodated into the handle 21. Further, an elastic element 253 is installed between the other end of the resisting block 23 and the second plate 25 or the third plate 26, wherein the elastic element 253 can apply an external force to the resisting block 23 to turn the blade 22 outwardly to the outside of the handle 21. When the other end of the elastic stop plate 251 abuts against an end of the blade 22, the resisting block 23 can be released from the first containing slot 261 and driven by the elastic force of the elastic element 253 to turn to a position capable of abutting against a side of the third plate 26 and another side of the elastic stop plate 251, such that the elastic stop plate 251 can be blocked by the resisting block 23, and the other end of the elastic stop plate 251 can maintain its status of abutting an end of the blade 22, and the blade 22 cannot be turned inwardly and accommodated in the handle 21.

In summation of the description above, the user simply needs to turn the blade 22 out from the handle 21 completely for using the safety folding knife 20 of the invention, and the other end of the elastic stop plate 251 can abut against an end of the blade 22 and release the resisting block 23 from the first containing slot 261 automatically. Now, the elastic element 253 will automatically drive the resisting block 23 to turn the resisting block 23 to a position capable of abutting against a side of the third plate 26 and another side of the elastic stop plate 251, so as to assure that the elastic stop plate 251 is blocked by the resisting block 23, and the blade 22 is situated securely at a completely unfolded state. On the other hand, if the user wants to fold the blade 22 back into the handle 31, the user simply needs to slide an end of the resisting block 23 and turn the resisting block 23 to a position for engaging the first containing slot 261 and then presses the elastic stop plate 251 to release the abutting force applied from the other end of the elastic stop plate 251 to an end of the blade 22 in order to fold the blade 22 back into the handle 21. With the design of the safety folding knife 20 in accordance with the present invention, the safety folding knife can prevent a sudden loss of the abutting force and prevent the blade 22 from turning back into the handle 21, when the blade 22 is situated at a completely unfolded state due to the deformation or displacement of the elastic stop plate 251 caused by applying an excessive force by the user. Obviously, the present invention can provide a safe way of using the folding knife.

With reference to FIGS. 2 and 3, the elastic element 253 of this preferred embodiment is a rod made of a metal material and bent into an arc shape, and an end of the elastic element 253 is wound or fixed by another method to the other end of the resisting block 23, and the other end of the elastic element 253 is embedded, hooked, or fixed by another method onto the second plate 25 or the third plate 26. Further, a second containing slot 262 is concavely formed on a side of the third plate 26 and at a position proximate to the first containing slot 261, wherein the second containing slot 262 has a shape matched with the arc shape of the elastic element 253 and interconnected with the first containing slot 261, such that when the first plate 24, the second plate 25 and the third plate 26 are assembled into the handle 21, and a side of the second plate 25 is attached onto a side of the third plate 26, the elastic element 253 can be accommodated into the second containing slot 262, and the second plate 25 and the third plate 26 can be attached more closely to reduce the overall volume of the safety folding knife 20. In addition to the metal material, the elastic element 253 can be made of a plastic material such as rubber, plastic, or any other equivalent material with an elastic force of the resisting block 23 to turn the resisting block 23 to a position capable of abutting a side of the third plate 26 and another side of the elastic stop plate 251. It is noteworthy to point out that the material of the elastic element 253 is not limited to metal or plastic only, and its shape is not limited to an arc shape only.

Although the handle 21 includes the elastic element 253 in this preferred embodiment, and the resisting block 23 can be driven by an elastic force of the elastic element 253 and turned to a position capable of abutting a side of the third plate 26 and another side of the elastic stop plate 251 to block the elastic stop plate 251 by the resisting block 23, yet manufacturers may choose not to install any elastic element 253 according to the actual application requirement. Therefore, the user simply needs to turn the blade 22 out from the handle 21 completely when using the safety folding knife 20 without the elastic element 253, wherein the other side of the elastic stop plate 251 can automatically abut against an end of the blade 22, such that the resisting block 23 can be released from the first containing slot 261. Now, the user can slide an end of the resisting block 23 and turn the resisting block 23 to a position capable of abutting a side of the third plate 26 and another side of the elastic stop plate 251 to assure that the elastic stop plate 251 is blocked by the resisting block 23 in order to situate the blade 22 securely into a completely unfolded state. On the other hand, if the user wants to fold the blade 22 back into the handle 21, the user simply needs to slide an end of the resisting block 23 and turn the resisting block 23 to a position for engaging the first containing slot 261 and then presses the elastic stop plate 251 to release the abutting force applied from the other end of the elastic stop plate 251 to an end of the blade 22 in order to fold the blade 22 back into the handle 21. Similarly, such arrangement can prevent a sudden loss of the abutting force and prevent the blade 22 from turning back into the handle 21, when the blade 22 is situated at a completely unfolded state due to the deformation or displacement of the elastic stop plate 251 caused by applying an excessive force by the user. The present invention can provide a safe way of using the folding knife.

While the invention has been described by way of example and in terms of a preferred embodiment, it is to be understood that the invention is not limited thereto. To the contrary, it is intended to cover various modifications and similar arrangements and procedures including the material and shape of the elastic element and the elastic stop plate and the curvature of the elastic element, etc, and the scope of the appended claims therefore should be accorded the broadest interpretation so as to encompass all such modifications and similar arrangements and procedures.

What is claimed is:

1. A safety folding knife, comprising:

a blade having a first end and a second end;

a handle having a first end and second end, composed of a first plate, a second plate and a third plate, wherein the first end of the blade is pivotally coupled to a position between the first plate and the second plate proximate to the first end of the handle through a pivot, such that when the second end of the blade rotates about the pivot, a side of the blade is turned outwardly to the outside of the handle or turned inwardly and accommodated into the handle, the second plate includes an elastic stop plate thereon, an end of the elastic stop plate is fixed onto the second plate, the other end of the elastic stop plate is tilted and extended in a direction towards the first plate, and during the process of turning the blade outwardly to the outside of the handle, a side of the elastic stop plate proximate to the first end of the blade is abutted against a side of the blade, and after the blade is turned out completely to the outside of the handle, the other end of the elastic stop plate abuts against the first end of the blade, such that the blade is situated at a completely unfolded state, and a first containing slot is concavely formed on an inner side of the third plate at a position corresponding to the other end of the second plate; and a resisting block, pivotally installed on another side of the elastic stop plate proximate to the other end of the elastic stop plate and movably fixed between the elastic stop plate and the third plate, wherein an end of the resisting block is extended outside the handle and tunable and rotatable by an external force, the resisting block is disposed at a position corresponding to the first containing slot and having a shape matched with the shape of the first containing slot, and when the resisting block is rotated to the first containing slot, engaged with the first containing slot, and accommodated into the first containing slot, the other end of the elastic stop plate will become a free end and separable from the first end of the blade by an external force, such that the blade can be turned inwardly and accommodated into the handle, and when the other end of the elastic stop plate abuts against the first end of the blade, the resisting block is released from the first containing slot and turned to a position capable of abutting the inner side of the third plate and the other side of the elastic stop plate, such that the elastic stop plate is blocked by the resisting block to maintain the other end of the elastic stop plate in a status of abutting against the first end of the blade, and the blade cannot be turned inwardly and accommodated into the handle.

2. A safety folding knife, comprising:

a blade having a first end and a second end;

a handle having a first end and a second end, composed of a first plate, a second plate and a third plate, wherein the first end of the blade is pivotally coupled to a position between the first plate and the second plate and proximate to the first end of the handle through a pivot, such that when the second end of the blade rotates about the pivot, a side of the blade is turned outwardly to the outside of the handle or turned inwardly and accommodated into the handle, the second plate includes an elastic stop plate thereon, an end of the elastic stop plate is fixed onto the second plate, the other end of the elastic stop plate is tilted and extended in a direction towards the first plate, and during the process of turning the blade outwardly to the outside of the handle, a side of the elastic stop plate proximate to the first end of the blade is abutted against a side of the blade, and after the blade is turned out completely to the outside of the handle, the other end of the elastic stop plate abuts against the first end of the blade, such that the blade is situated at a completely unfolded state, and a first containing slot is concavely formed on an inner side of the third plate at a position corresponding to the other end of the second plate; and a resisting block, pivotally installed on another side of the elastic stop plate proximate to the other end of the elastic stop plate and movably fixed between the elastic stop plate and the third plate, wherein an end of the resisting block is extended outside the handle and tunable and rotatable by an external force, the resisting block is disposed at a position corresponding to the first containing slot and having a shape matched with the shape of the first containing slot, and when the resisting block is rotated to the first containing slot, engaged with the first containing slot, and accommodated into the first containing slot, the other end of the elastic stop plate will become a free end and separable from the first end of the blade by an external force, such that the blade can be turned inwardly and accommodated into the handle, and an elastic element is installed between another end of the resisting block and the end of the elastic stop plate and between the second blade and the third plate for applying an elastic force to the resisting block, such that when the blade is turned outwardly to the outside of the handle, and the other end of the elastic stop plate abuts against the first end of the blade, the resisting block is released from the first containing slot and driven by the elastic force of the elastic element to turn to a position capable of abutting the inner side of the third plate and the other side of the elastic stop plate, and the elastic stop plate is blocked by the resisting block, so that the other end of the elastic stop plate can maintain the status of abutting against the first end of the blade, and the blade cannot be turned inwardly and accommodated into the handle.

3. The safety folding knife of claim 2, further comprising a second containing slot concavely formed on the inner side of the third plate and at a position proximate to the first containing slot, wherein the second containing slot has a shape matched with the shape of the elastic element and interconnected with the first containing slot, such that when the first plate, the second plate and the third plate are combined as a whole, the elastic element is accommodated into the second containing slot.

4. The safety folding knife of claim 3, wherein the elastic element is a rod made of metal material and bent into an arc shape.

5. The safety folding knife of claim 4, wherein an end of the elastic element is wound or fixed to the other end of the resisting block, and the other end of the elastic element is embedded, hooked or fixed onto the second plate.

6. The safety folding knife of claim 3, wherein the elastic element is made of a plastic material an bent into an arc shape.

7. The safety folding knife of claim 6, wherein an end of the elastic element is wound or fixed to the other end of the resisting block, and the other end of the elastic element is embedded, hooked or fixed onto the second plate.

* * * * *